US005984132A

United States Patent [19]

Dinouard

[11] Patent Number: 5,984,132

[45] Date of Patent: Nov. 16, 1999

[54] INTERNALLY PRESSURIZED FLUID CONTAINER

[75] Inventor: Gerard Dinouard, Lille, France

[73] Assignee: ODIN, Lille, France

[21] Appl. No.: 08/747,041

[22] Filed: Nov. 12, 1996

Related U.S. Application Data

[63] Continuation of application No. PCT/FR95/00613, May 10, 1995.

[30] Foreign Application Priority Data

May 11, 1994 [FR] France ..... 94 06025

[51] Int. Cl.[6] ..... B65Q 81/02

[52] U.S. Cl. ..... 220/586; 206/524; 206/594; 220/23.91

[58] Field of Search ..... 220/408, 419, 220/429, 444, 465, 581, 586, 23.91; 222/105, 183; 206/524, 594

[56] References Cited

U.S. PATENT DOCUMENTS

| | | | |
|---|---|---|---|
| 2,054,754 | 9/1936 | Kellogg | 220/429 |
| 2,184,336 | 12/1939 | Devine | 220/429 |
| 2,744,042 | 5/1956 | Pace | 220/444 |
| 2,759,337 | 8/1956 | Katz | 220/429 |
| 3,069,045 | 12/1962 | Haumann et al. | 220/465 |
| 4,136,141 | 1/1979 | Bauer et al. | 220/444 |
| 4,190,159 | 2/1980 | Hoyt | 220/444 |
| 4,793,491 | 12/1988 | Wolf et al. | 220/444 |
| 5,117,810 | 6/1992 | Threatt | 220/444 |
| 5,390,580 | 2/1995 | Gibbons, Jr. et al. | 220/429 |

FOREIGN PATENT DOCUMENTS

| | | | |
|---|---|---|---|
| 1077771 | 8/1967 | United Kingdom | 220/429 |

*Primary Examiner*—Gary E. Elkins
*Attorney, Agent, or Firm*—Oppedahl & Larson LLP

[57] ABSTRACT

An internally pressurized fluid vessel, in particular for liquids and/or gases exerting pressure outwards from the container has a sandwich structure capable of withstanding the internal pressure. The vessel has an interior container, an outer jacket in which the container is positioned and a material filling the space between the container and the outer jacket.

11 Claims, 3 Drawing Sheets

INTERNALLY PRESSURIZED FLUID CONTAINER

This application is a continuation of International patent application Ser. No. PCT/FR95/00613 filed May 10, 1995 designating the United States.

BACKGROUND OF THE INVENTION

The object of the present invention is a vessel for fluid having internal pressure, such as liquids and/or gas exerting a pressure from inside the vessel toward the outside thereof, as well as a process designed especially for its fabrication.

The vessel of the invention will find use in all economic spheres in which fluids having internal pressure are handled and/or stored. Such vessels may, for example, be vessels in which fluid exerts an internal pressure due to its own nature, such as drums containing gaseous and/or fermenting beverages, gas bottles, fire extinguishers or the like. The vessels may likewise be vessels in which, for example, the internal pressure exerted by the fluid comes from the pressure of a distribution network of which they are a part, such as water storage heaters, central heating expansion tanks, pool filters, sand filters, brake circuit reservoirs,. water fountain reservoirs, compressed air or other reservoirs.

Thus, one application involves use of the present invention in, for example, the brewery industry as conditioning vats for nutrient liquids such as beer. However, this is not limiting.

At the present time, it is known that various types of vessels of thermoplastic material, such as polyethylene or polypropylene, may be used to store and/or transport fluids having internal pressure. These vessels have the disadvantage of not being strong enough to withstand internal pressures when they are too high. Their resistance to shocks is likewise low.

On the other hand, various types of principally metal vessels, made of stainless steel or aluminum, are well known. A disadvantage of this type of vessels is that they are costly and heavy. In addition, they oblige their users to engage in numerous efforts, particularly recycling, resulting in an increase in the final cost price.

The object of the present invention is to propose a vessel which makes it possible to mitigate the disadvantages of the known devices and which at the same time is resistant to an internal pressure and is lighter than the principally metal vessels mentioned above.

Another object of the invention is to propose a vessel likewise resistant to external mechanical shocks.

Another object of the invention is to facilitate its use thanks to its characteristics of weight and shape.

Another object of the invention is to propose a vessel exhibiting, in addition, characteristics of thermal insulation and impermeability to gases and liquids associated with the nature and properties of the fluid contained.

Another object of this invention is to propose, secondarily, a disposable vessel, in view of its cost price.

Other objects and advantages of the present invention will appear in the course of the description to follow, which is given only by way of indication and which does not aim to be limiting.

SUMMARY OF THE INVENTION

According to the invention, the vessel for fluid having internal pressure, such as, notably, liquids and/or gases exerting a pressure from inside the vessel toward the outside thereof, is characterized in that it has a sandwich structure comprising:

a container for fluid, an outer jacket defining, with the container, a space, means for relative positioning of the container and the outer jacket, a layer of a material completely filling the space. This sandwich structure is capable of withstanding the internal pressure by distribution of stresses among the container, the layer, and the outer jacket.

Likewise an object of the invention is a process designed especially for fabrication of the said vessel, intended for fluids having internal pressure such as liquids and/or gases exerting a pressure from inside the vessel toward the outside thereof, characterized in that:

a container is formed, an outer jacket, capable of enclosing the said container, is formed, the container is centered in the outer jacket using a positioning means, thus defining a space between the container and the jacket, the outer jacket is placed in a shaping jig, and a material for completely filling the space is inserted.

BRIEF DESCRIPTION OF THE DRAWINGS

The invention will be understood better by reference to the following description as well as to the accompanying drawings, which are an integral part thereof.

DETAILED DESCRIPTION OF THE INVENTION

Figure 1:
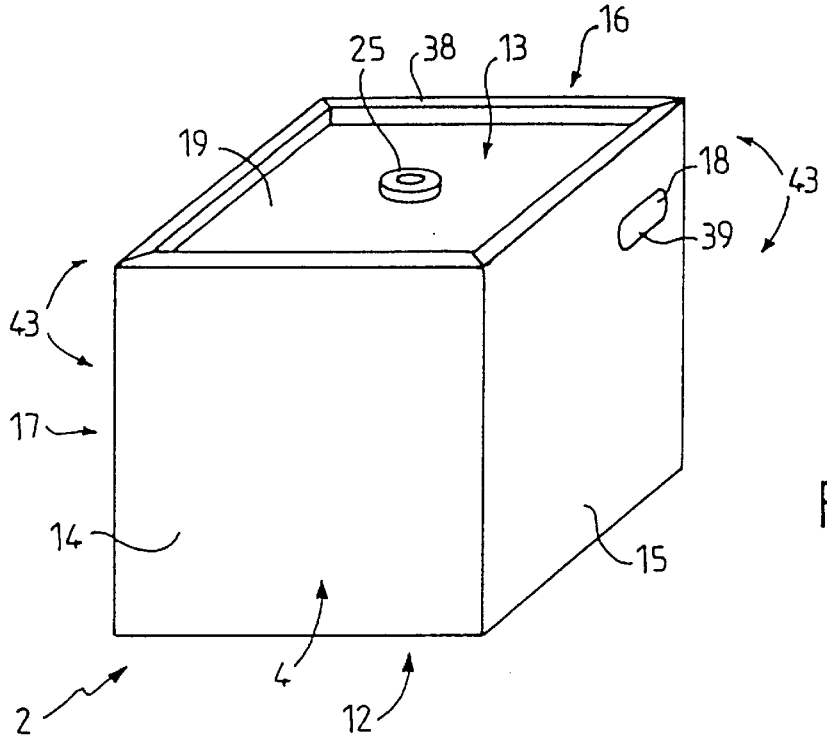
FIG. 1 is a perspective view of one embodiment of a vessel according to the present invention.

The object of the invention is a vessel for fluids having internal pressure, such as liquids and/or gas exerting a pressure from inside toward to outside of the vessel. FIG. 1 shows a perspective view of the particular embodiment mentioned above. Its structure is detailed in the figures which follow.

Figure 3:
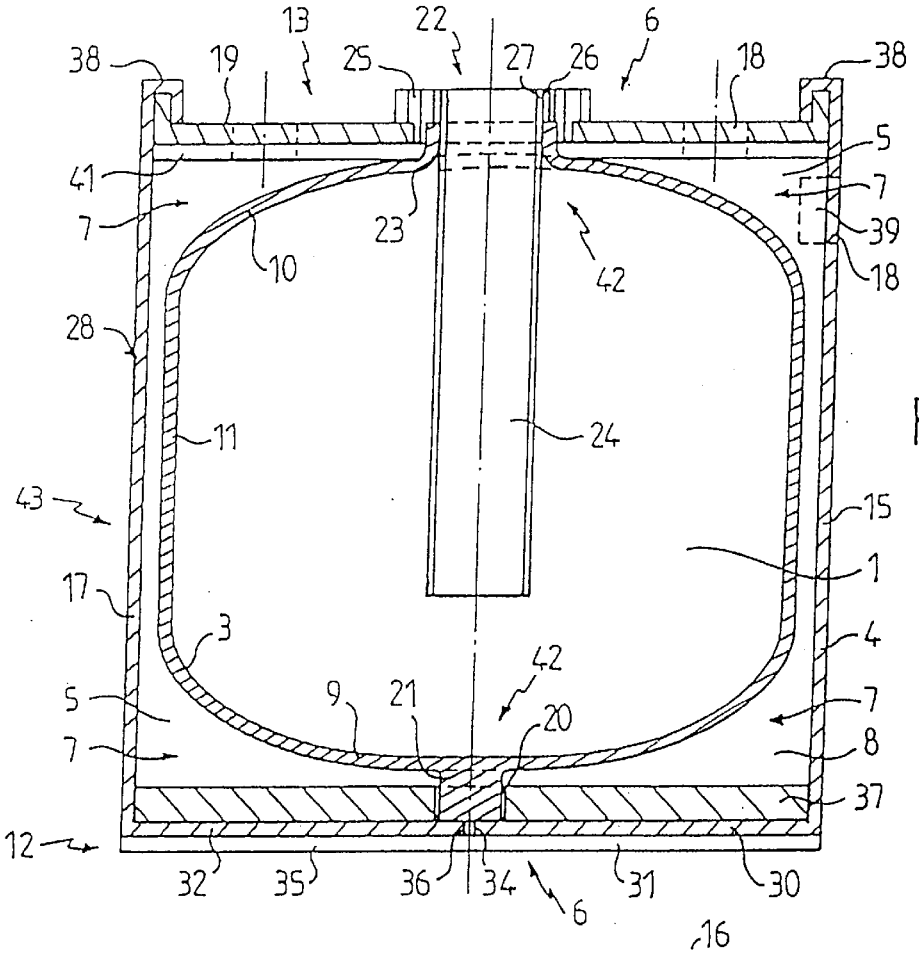
FIG. 3 is a sectional view along the line III—III of FIG. 2.
Figure 2:
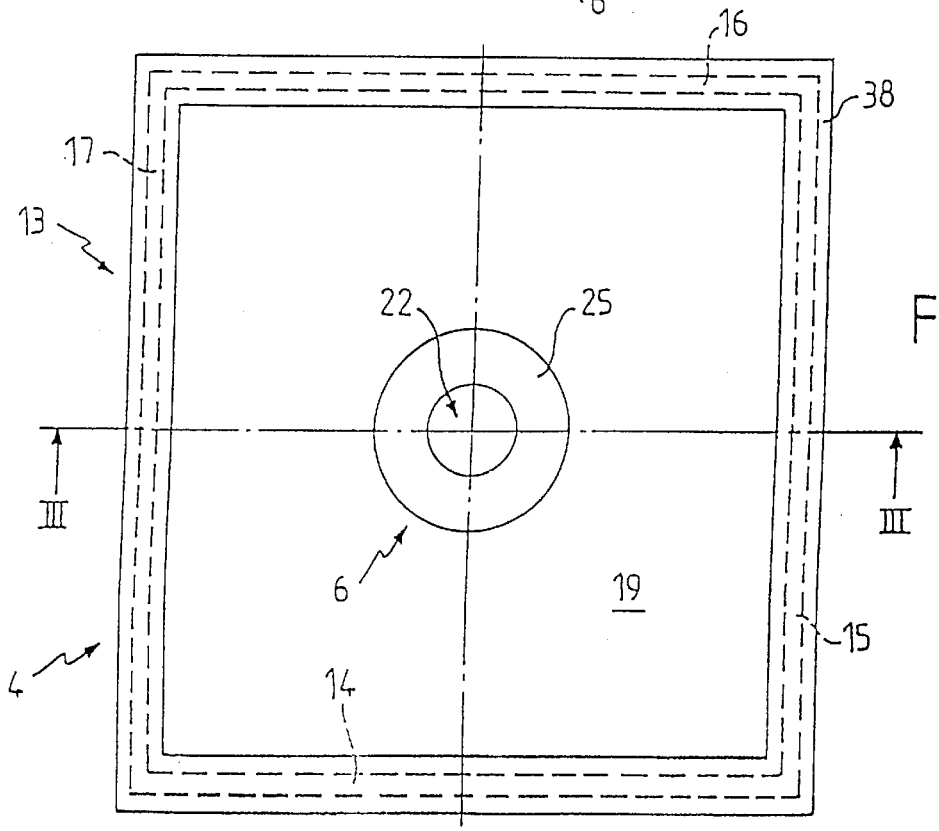
FIG. 2 is a top view of the vessel represented in the preceding figure.

Referring to FIGS. 2 and 3, the vessel for containing fluids having internal pressure 1 has a sandwich structure 2. In the field of brewing, for example, internal pressure may rise to 7 bars. This sandwich structure 2 is capable of withstanding such stresses.

To withstand internal pressure, the vessel comprises a container 3 for the fluid 1 and an outer jacket 4, thus defining between them a space 5. The sandwich structure 2 likewise comprises positioning means 6 for relative positioning of the container 3 and the outer jacket 4 and a layer 7 of a material 8 completely filling the space 5.

It is as a result of the cooperation of the container 3, the outer jacket 4 and the layer 7 that the vessel is capable of withstanding high internal pressures thanks to the so-called "sandwich effect," which permits the distribution and diffusion of pressure stresses. The sandwich structure 2 is all the more effective since the layer 7 hugs both the outer surface of the container 3 and the inner surface of the outer jacket 4 and contains no bulges.

Again according to FIG. 3, the container 3, for example, has a base 9 and a top 10 provided, for example, with a neck 23. In the particular embodiment illustrated in this figure, the base 9 and the top 10 have a shape as closely as possible approaching a semi-ellipsoid of revolution. This profile, compared with other volumes having projecting sides, will permit better distribution of stresses exerted by the internal pressure of the contents.

In the same embodiment, the container is likewise composed of a lateral member 11 connecting the base 9 and the top 10. The member 11 has a shape approaching, for example, that of a cylinder. This permits increasing the inner volume of the container 2. The latter thus has a shape that reconciles volumetric capacity and resistance to pressure stresses. It has at least one orifice.

According to an embodiment of the invention not represented, the container 2 may likewise be reinforced by metal or other hoops. These make it possible to ensure better resistance to pressure.

If reference is made to FIG. 1, it is found that the outer jacket 4, for example, is parallelepipedal in shape. It permits, notably, inclusion of the container 3. According to FIGS. 2 and 3, it is made up, for example, of a bottom 12, a cover 13 and lateral sides 43.

To avoid deterioration of the outer jacket 4 during handling of the liquid, the cover 13, for example, has an impermeable outer surface 19.

According to other embodiments not represented, the outer jacket 4 may alternatively have a cylindrical, polyhedral or other shape depending upon the handling and/or storage constraints associated with its use.

FIG. 3 likewise shows a particular example of the fixed points of contact 42. According to this embodiment, the relative positioning means 6 are composed, for example, on the one hand of a seat 20 arranged in the bottom 12. This seat cooperates with a centering stud 21, provided at the base 9 of the container 3.

The seat 20 and the stud 21, for example, are cylindrical in shape. The stud 21 is made, at the time of fabrication of the container 3, for example, by extrusion blow-molding.

The relative positioning means 6 likewise comprise, for example, an orifice 22, arranged in the cover 13. It cooperates with the neck 23 provided at the top 10 of the container 3.

According to the particular embodiment represented in FIG. 3, the relative positioning means 6 in addition comprise, for example, a sealing washer 25 inserted between the orifice 22 of the cover 13 and the neck 23 of the container 3.

Otherwise, the container 3 in addition comprises, for example, a filling and/or draining pipe 24. This pipe 24 is provided with means for stoppering it tightly, known to persons skilled in the art and not represented in the various figures. The washer 25 is provided with a threaded orifice 26 cooperating with a thread 27 machined at one end of the pipe 24.

Figure 7:
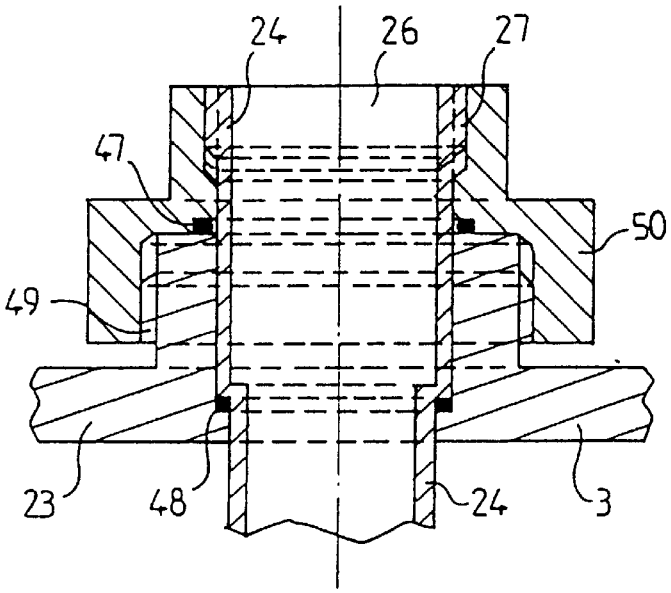
FIG. 7 is a partial view in section along the line III—III of an embodiment of an orifice of the vessel according to the invention.

A particular embodiment of the orifice of the container 3 may be seen in FIG. 7. A piece 50, generated by revolution, constituting a stuffing box, is provided in its lower part with a thread 49 and in its upper part with the threaded orifice 26. It is thus capable of joining the container 3, at the level of the thread 49, and the pipe 24 by means of its thread 27. This connection is made tight by means of an upper elastic joint 47 and a lower elastic joint 48.

Figure 4:
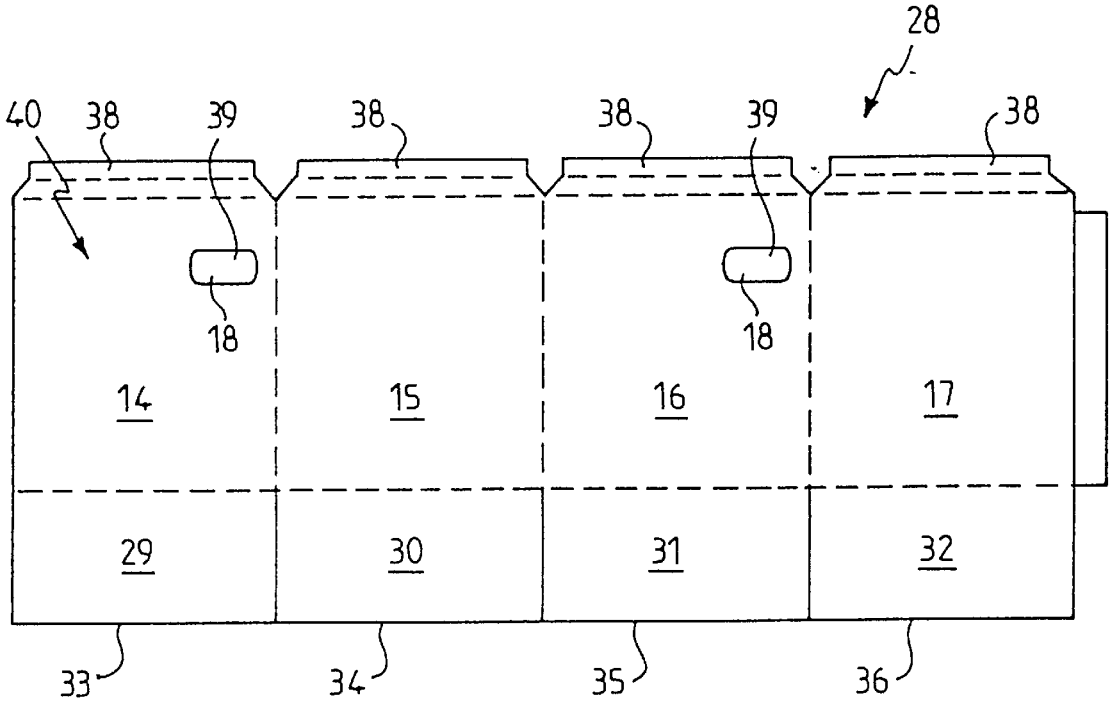
FIG. 4 presents a cardboard panel suitable for constituting a base and sides of the outer jacket of the vessel represented in FIG. 1.

According to FIGS. 2 and 4, the outer jacket 4, more precisely, is constituted of, for example, a box 28, known by the name of American half-box. The box 28 comprises flaps 29, 30, 31, 32 constituting a prolongation of plane surfaces 14, 15, 16, 17 forming the sides 43. These flaps 29, 30, 31, 32 are provided with contiguous edges 33, 34, 35, 36. Thus, they reinforce the square shape of the outer jacket 4.

The latter in addition comprises, for example, a reinforcing plate 37 of the bottom 12 in which is arranged the seat 20. In this embodiment some of the plane surfaces 14, 15, 16, 17 comprise at least one orifice 18 for insertion of the material 8 completely filling the space 5.

The cover 13 is firmly attached to these plane surfaces 14, 15, 16, 17 by a fold 38. Other embodiments may have a box 28 known as an American box. The seat 20 and the orifice 22 may be formed directly in the corresponding flaps of the box 28.

To facilitate handling, the outer jacket 2 in addition comprises, for example, hand-holds 39. According to the particular embodiment represented, these are formed by oblong orifices 18 extended by spaces reserved in the material 8 completely filling the space 5.

The materials of the sandwich structure 2 are chosen according to their properties.

The container 3, for example, is made of a thermoplastic material particularly suitable for facilitating shaping and ensuring impermeability to liquids and gases. This may be polyethylene or polypropylene or, in another embodiment, metal, glass or some other material.

The outer jacket 4, for example, is made of a panel 40 of cardboard, wood, or light laminate, for example, of thermoplastic and/or duroplastic or some other material. In the case of card-board, the cardboard may be coated and/or corrugated.

The material 8 completely filling the space 5 is composed of a duroplastic and/or thermoplastic foam, expanded or not, chosen for its properties of mechanical strength. It may, for example, be a vinyl polychloride, a vinylidene polychloride, a poly-urethane or some other material.

Figure 5:
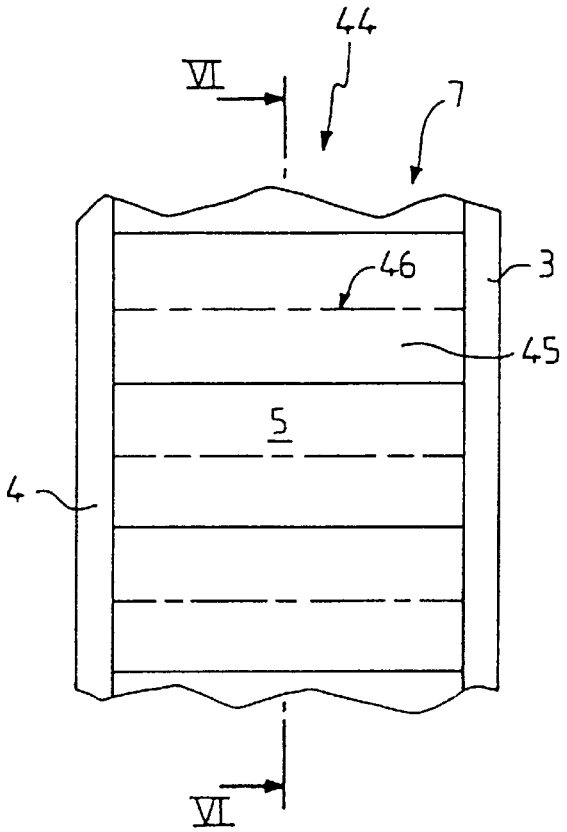
FIG. 5 presents a partial side view of a variant embodiment of the layer of material completely filling the space between the container and the outer jacket.
Figure 6:
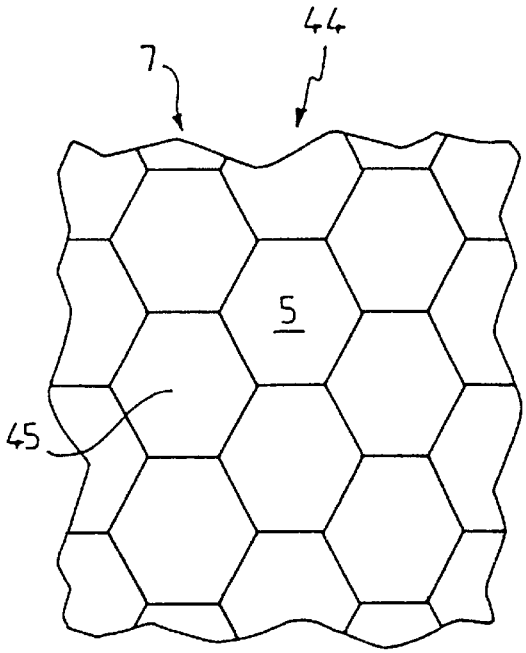
FIG. 6 is a partial face section along the line VI—VI of FIG. 5.

In another embodiment, shown in FIGS. 5 and 6, the layer 7 of material 8 completely filling the space 5 is in the form of a structure 44, known as honeycomb and constituted, for example, of thermoplastic material. This honeycomb structure 44, for example, has cells 45 having longitudinal axes 46, substantially perpendicular to the container 3 and to the outer jacket 4.

According to a first variant, this honeycomb structure 44, for example, comprises cells coated on each side with a non-woven material which is cemented on the one hand against the outer wall of the container 3 and, on the other hand, against the inner wall of the outer jacket 4.

In another variant, the honeycomb structure 44 is in the form of ribs obtained by rotational molding of the container 3.

In another variant, this same structure contains cells obtained by duplicate molding of a thermoplastic resin, such as polyethylene, on the container 3.

In this case, in the particular embodiment of the invention represented in FIG. 3, there is found, in addition, a buffer layer 41 of cellular foam-based thermoplastic material. It is placed between the cover 13 and the layer 7 of material 8 filling the space 5.

According to a particular embodiment of the invention, the combination of materials used in the vessel may make it a disposable product, in view of its cost.

The object of the invention likewise is a process designed especially for fabrication of the vessel for fluids having internal pressure such as, notably, liquids and/or gases exerting a pressure from inside the vessel toward the outside of the latter.

According to the invention, a container 3 is formed. Extrusion blow-molding, for example, may be employed for this.

An outer jacket 4, capable of enclosing the container 3, is formed, notably, by folding of a panel 40 of cardboard like the one represented in FIG. 4. This figure shows dotted lines constituting, in the corresponding particular embodiment, folding lines.

Thus a bottom 12 is obtained by overlapping of the flaps 29, 30, 31, 32. A reinforcing plate 37, provided with a seat 20, is superposed.

The container 3 is centered in the outer jacket 4 by means of relative positioning means 6. The relative positioning means 6, for example, comprise a stud 21 which, for example, engages in the seat 20. In addition, centering is improved by positioning a plate, constituting a cover 13 of the outer jacket 4, by means of an orifice 22 made in the cover 13 cooperating with a neck 23 of the container 3.

The container 3 and the outer jacket 4 between them thus define a space 5.

The outer jacket 4 is then placed in a shaping jig and, when deemed necessary, the container 3 may be filled with a liquid suitable for exerting a counterpressure. The liquid may, for example, be water.

According to the particular embodiment presented, the shaping jig comprises projections participating in the formation of hand-holds 39.

A material 8 is then inserted through orifices 18 to completely fill the space 5. The orifices are constituted, for example, by at least one of the hand-holds 39 left free of access before complete closing of the shaping jig.

Depending upon the case, the material 8, which may for example be a thermoplastic foam, is subjected to expansion and this expansion may be controlled by a buffer layer 40. The latter thus produces a filling clearance which keeps the container 3 and the outer jacket 4 from being damaged during expansion.

Expansion may be controlled, in addition, for example, by temperature adjustment.

Other embodiments of the present invention within the reach of persons skilled in the art may of course be envisaged without thereby exceeding the scope of this application.

What is claimed is:

1. A vessel for fluids having internal pressure comprising:

(a) a container for fluid, said container having a base, a top having a shape approaching that of a semi-ellipsoid of revolution, and a lateral member whose shape approaches that of a cylinder, and being provided with at least one orifice;

(b) an outer jacket comprising a bottom, lateral sides and a cover enclosing the container, the said outer jacket being parallelepipedal, cylindrical or polyhedral in shape, wherein the outer jacket comprises a box of which the lateral sides are each a planar surface, and are provided with at least one orifice for insertion of material to form the layer of material completely filling the space and with a fold for firmly attaching the cover and the lateral sides, and the bottom has flaps extending from the lateral sides and folded across the bottom for reinforcing the box in a square shape and a reinforcing plate in which is arranged a seat;

(c) means comprising at least two fixed points of contact for relative positioning of the container and the outer jacket to define a space between the container and the outer jacket, wherein said two fixed points of contact are centrally disposed adjacent to the base and top of the container, and wherein the fixed points of contact comprise a seat arranged in the bottom cooperating with a centering stud provided at the base of the container, and an orifice in the cover cooperating with a neck of the container; and (d) a layer of material completely filling the space, wherein the container, the layer of material and the outer jacket together form a sandwich structure for withstanding the internal pressure by distribution of stresses among the container, the material and the outer jacket.

2. The vessel according to claim 1, wherein the container is made of a thermoplastic material, and the material forming the layer of material completely filling the space is composed of an expanded thermoplastic foam.

3. The vessel according to claim 1, wherein the layer of material completely filling the space has a honeycomb structure.

4. The vessel according to claim 1, wherein the outer jacket is made from a panel of cardboard, wood or light laminate.

5. The vessel according to claim 1, wherein at least the lateral sides of the entire outer jacket are formed from a single, contiguous piece of material.

6. The vessel according to claim 1, wherein the container is made of a thermoplastic material, and the material forming the layer of material completely filling the space is composed of an expanded thermoplastic foam.

7. The vessel according to claim 1, wherein the layer of material completely filling the space has a honeycomb structure.

8. The vessel according to claim 1, characterized in that the cover and the layer of material filling the space are separated by a buffer layer of cellular foam-based thermoplastic or duroplastic material.

9. A vessel for fluids having internal pressure comprising:

(a) a container for fluid, said container having a base, a top having a shape approaching that of a semi-ellipsoid of revolution, and a lateral member whose shape approaches that of a cylinder, and being provided with at least one orifice;

(b) an outer jacket comprising a bottom, lateral sides and a cover enclosing the container, the said outer jacket being parallelepipedal, cylindrical or polyhedral in shape, wherein the outer jacket is made from a panel of cardboard, wood or light laminate;

(c) means comprising at least two fixed points of contact for relative positioning of the container and the outer jacket to define a space between the container and the outer jacket, wherein said two fixed points of contact are centrally disposed adjacent to the base and top of the container; and (d) a layer of material completely filling the space, wherein the container, the layer of material and the outer jacket together form a sandwich structure for withstanding the internal pressure by distribution of stresses among the container, the material and the jacket.

10. A vessel according to claim 9, wherein the fixed points of contact comprise a seat arranged in the bottom cooperating with a centering stud provided at the base of the container, and an orifice in the cover cooperating with a neck of the container:

wherein the outer jacket comprises a box of which the lateral sides are each a planar surface, and are provided with at least one orifice for Insertion of material to form the layer of material completely filling the space and with a fold for firmly attaching the cover and the lateral sides, and the bottom has flaps extending from the lateral sides and folded across the bottom for reinforcing the box in a square shape and a reinforcing plate in which is arranged the seat.

11. The vessel according to claim 9, characterized in that the cover and the layer of material filling the space are separated by a buffer layer of cellular foam-based thermoplastic or duroplastic material.

* * * * *